US008523248B2

(12) United States Patent
Tien

(10) Patent No.: US 8,523,248 B2
(45) Date of Patent: Sep. 3, 2013

(54) LATCH ASSEMBLY WITH A SAFETY DEVICE FOR A FIREPROOF DOOR LOCK

(75) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 161 days.

(21) Appl. No.: 13/272,275

(22) Filed: Oct. 13, 2011

(65) Prior Publication Data

US 2013/0093195 A1 Apr. 18, 2013

(51) Int. Cl.
*E05C 3/02* (2006.01)
*E05B 65/10* (2006.01)

(52) U.S. Cl.
USPC ..... 292/194; 292/92; 292/DIG. 65

(58) Field of Classification Search
CPC ..... A61B 18/1492; E05B 77/06
USPC ..... 292/1, 92–94, 194, DIG. 61, DIG. 65, 292/DIG. 66; 70/92
See application file for complete search history.

(56) References Cited

U.S. PATENT DOCUMENTS 4,741,563 A 5/1988 Cohrs ..... 292/21
4,961,330 A 10/1990 Evans ..... 292/21
4,974,890 A 12/1990 Cohrs ..... 292/363.3
5,702,134 A * 12/1997 Hsieh ..... 292/92
6,009,732 A * 1/2000 Haeck et al. ..... 70/92
6,145,897 A * 11/2000 Locher ..... 292/92
6,779,819 B2 * 8/2004 Surko, Jr. ..... 292/92
6,854,773 B2 * 2/2005 Lin ..... 292/92
7,144,050 B2 * 12/2006 Lin ..... 292/93
7,287,784 B2 * 10/2007 Lin ..... 292/92
7,887,107 B2 2/2011 Shen ..... 292/92
2004/0124639 A1 * 7/2004 Lin ..... 292/92
2009/0194999 A1 * 8/2009 Shen ..... 292/219
2011/0239712 A1 * 10/2011 Tien ..... 70/92

* cited by examiner

*Primary Examiner* — Carlos Lugo
*Assistant Examiner* — Nathan Cumar
(74) *Attorney, Agent, or Firm* — Alan Kamrath; Kamrath IP Lawfirm, P.A.

(57) ABSTRACT

A latch assembly includes a base having two sidewalls each having a positioning hole. A follower plate includes two sidewalls each having an engagement hole that is aligned with the positioning holes when the latch is in a latching position and that is not aligned with the positioning holes when the latch is in an unlatching position. Two sleeves are mounted between the sidewalls of the follower plate. An end of each sleeve is received in the engagement hole of one of the sidewalls of the follower plate. A stop having a low melting point is received in each sleeve to retain a safety pin in the sleeve. When the stops melt due to heat of a fire while the latch is in the latching position, the safety pins are moved by a spring into the positioning holes of the base to retain the latch in the latching position.

4 Claims, 13 Drawing Sheets

4
86
85
8
81
44
87
84
41
411
85
87
421
412
425
42
423
422
424
82
83
43
55
37
329
31
72
73
3
321
33
741
329
74
32
321
56
7
742
324
324
32
328
323
325
327
322
325
322
521
53
71
711
713
53
51
716
712
34
712
715
524
524
719
523
523
718
57
527
525
52
529
61
717
714
611
522
54
52
522
5
6
24
62

X
Z
Y
801B
805
819
803
857B
817

LATCH ASSEMBLY WITH A SAFETY DEVICE FOR A FIREPROOF DOOR LOCK

BACKGROUND OF THE INVENTION

The present invention relates to a latch assembly for a fireproof door lock and, more particularly, to a latch assembly with a safety device for a fireproof door lock for a door mounted in a passageway or panic exit, with top and bottom latches of the fireproof door lock retained in the latching positions during a fire to avoid expansion of the fire and smoke by avoiding opening of the door.

Fireproof door locks are generally mounted to fireproof doors in passageways or panic exits and generally include horizontal type latches and vertical type latches. Vertical type latches include a top latch and a bottom latch. The fireproof lock door should be remained in the closed position during a fire to avoid expansion of the fire or smoke. However, the parts of the fireproof door lock may deform due to the high temperature of the fire, such that the door can not be retained in the closed position. Specifically, the latch bolts of the top and bottom latches may be moved to the retracted, unlatching position due to deformation resulting from the heat of the fire. As a result, there is a risk of expansion of the fire and smoke if the door is opened.

Thus, a need exists for a safety device for a fireproof door lock in which the top and bottom latches of the fireproof door lock can be reliably retained in the latching positions during a fire.

BRIEF SUMMARY OF THE INVENTION

The present invention solves this need and other problems in the field of fireproof door locks by providing a latch assembly including a base having first and second sidewalls and a main section extending between the first and second sidewalls. Each of the first and second sidewalls includes a positioning hole. The main section is adapted to be mounted to a door. A latch bolt is movably received between the first and second sidewalls of the base. The latch bolt includes a latch having a first pivotal portion pivotably connected to the first and second sidewalls of the base and a second pivotal portion. The latch is movable between a latching position outside the base and an unlatching position inside the base. A link includes a first end pivotably connected to the second pivotal portion of the latch and a second end. The second end of the link is slideably engaged with the first and second sidewalls of the base. Movement of the link along a first axis causes movement of the latch between the latching position and the unlatching position. A follower plate is movable along the first axis and includes first and second sidewalls spaced along a second axis perpendicular to the first axis. Each of the first and second sidewalls of the follower plate includes first and second ends. An engagement hole is formed in each of the first and second sidewalls of the follower plate and located between the first and second ends of the first and second sidewalls of the follower plate. The first and second sidewalls of the follower plate are movably received between the first and second sidewalls of the base. The first ends of the first and second sidewalls of the follower plate are pivotably connected to the second end of the link, allowing pivotal movement of the follower plate and the link relative to the base, and allowing relative pivotal movement between the follower plate and the link to permit movement of the follower along the first axis. The engagement holes of the follower plate are aligned with the positioning holes of the base when the latch is in the latching position. The engagement holes of the follower plate are not aligned with the positioning holes of the base when the latch is in the unlatching position. A linking rod includes a first end coupled with the second ends of the first and second sidewalls of the follower plate to move therewith. The linking rod further includes a second end adapted to be connected to a vertical rod of a door lock mounted to the door to move therewith.

The latch assembly further includes a first sleeve having first and second ends spaced along the second axis. A receiving hole extends from the first end through the second end of the first sleeve. The receiving hole includes a smaller section extending from the first end towards but spaced from the second end of the first sleeve and a larger section extending from the second end through the smaller section and having a diameter larger than the smaller section. The first end of the first sleeve is received in the engagement hole of the first sidewall of the follower plate. A second sleeve includes first and second ends spaced along the second axis. A mounting hole extends from the first end through the second end of the second sleeve. The mounting hole includes a first hole section extending through the first end of the second sleeve and a second hole section extending through the second end of the second sleeve. The second end of the second sleeve is engaged with the second end of the first sleeve. The first end of the second sleeve is received in the engagement hole of the second sidewall of the follower plate. The first and second sleeves are movable together with the follower plate. A first stop is received in the larger section of the receiving hole of the first sleeve and has a melting point lower than the first and second sleeves. A second stop is received in the mounting hole of the second sleeve and has a melting point lower than the first and second sleeves.

The latch assembly further includes a first safety pin received in the receiving hole of the first sleeve. The first safety pin includes a first shank having a first distal end. A flange is formed on an end of the first shank opposite to the first distal end and has a diameter larger than a diameter of the first shank. The first shank of the first safety pin extends through the first stop into the smaller section but not extends beyond the first end of the first sleeve. The first stop is located between the first flange of the first safety pin and the smaller section of the first sleeve. A second safety pin is received in the mounting hole of the second sleeve. The second safety pin includes a second shank having a second distal end. A second flange is formed on an end of the second shank opposite to the second distal end and has a diameter larger than a diameter of the second shank. The second shank of the second safety pin extends through the second stop into the first hole section but not extending beyond the first end of the second sleeve. The second stop is located between the second flange of the second safety pin and the first hole section of the second sleeve. A spring is mounted in the larger section of the receiving hole of the first sleeve and includes a first end pressing against the first flange of the first safety pin and a second end pressing against the second flange of the second safety pin. The spring biases the first and second safety pins towards the first and second sidewalls of the base.

When the latch is in the latching position and when the first and second stops melt by heat such as during a fire, the spring moves the first distal end of the first safety pin into the positioning hole of the first sidewall of the base and moves the second distal end of the second safety pin into the positioning hole of the second sidewall of the base, preventing the follower plate from moving relative to the base along the first axis. Thus, the latch is retained in the latching position during the fire.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
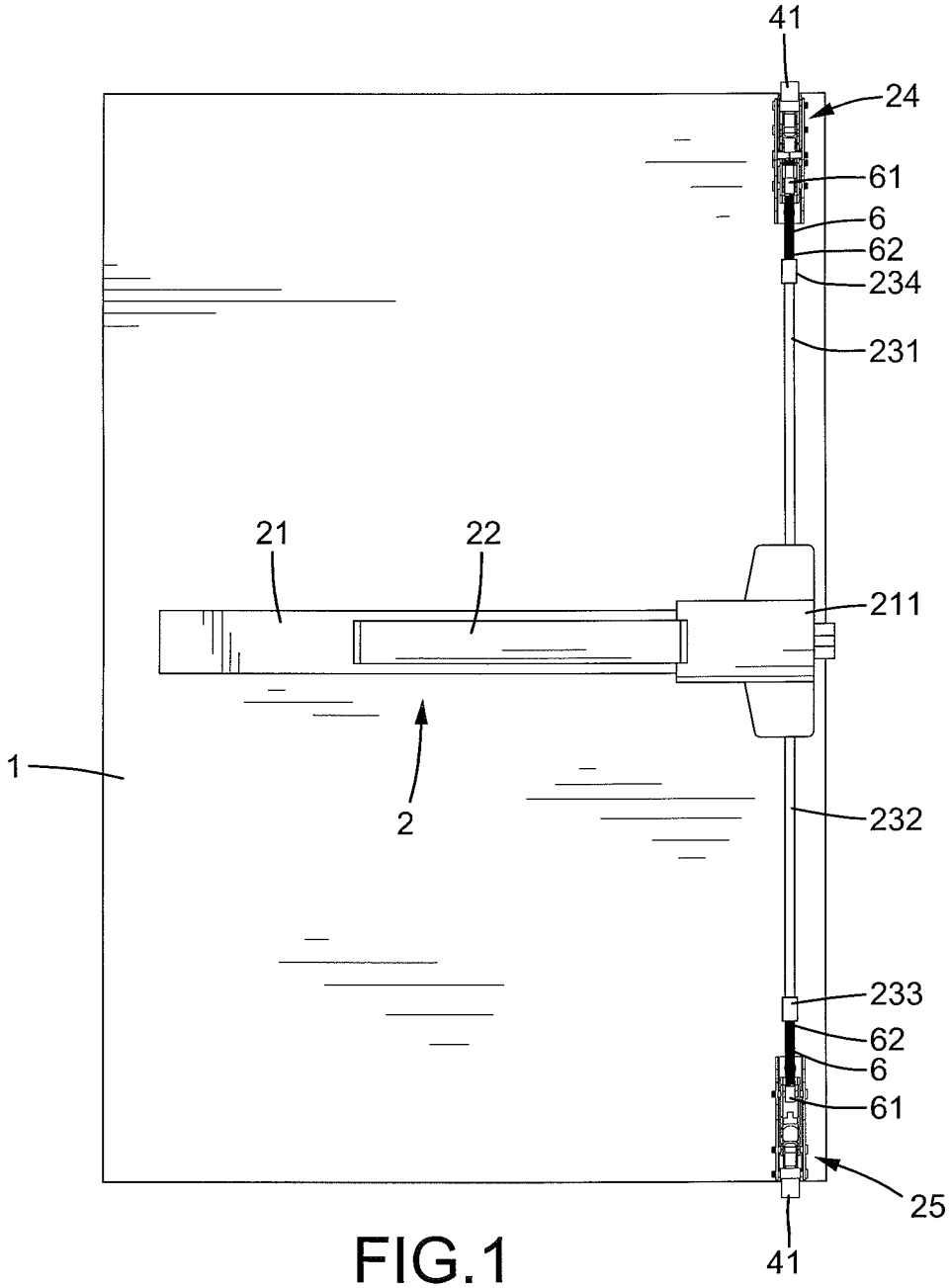
FIG. 1 shows a diagrammatic side view of a door lock mounted to a fireproof door and utilizing latch assemblies with safety devices according to the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "upper", "top", "bottom", "inner", "outer", "end", "portion", "section", "longitudinal", "vertical", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIG. 1 shows a fireproof door lock 2 mounted to a fireproof door 1 in a panic exit or the like. In the form shown, door lock 2 includes a housing 21 is mounted to door 1, a touch bar 22 mounted outside housing 21 for manual operation, and a transmission mechanism (not shown) mounted in an end 211 of housing 21. Door lock 2 further includes a top latch 24 and an upper vertical rod 231 having a lower end coupled with the transmission mechanism and an upper end 234 coupled with top latch 24. Door lock 2 further includes a bottom latch 25 and a lower vertical rod 232 having an upper end coupled with the transmission mechanism and a lower end 233 coupled with bottom latch 25. When touch bar 22 is pressed, upper and lower vertical rods 231 and 232 are moved toward each other in a vertical direction to unlatch top and bottom latches 24 and 25. The transmission mechanism can be of any desired form as conventional including but not limited to of a commercially available type.

In the form shown, bottom latch 25 is comprised of basic parts of top latch 24. According to the form shown, bottom latch 25 includes a base 3, a latch bolt 4, a follower plate 5, and a linking rod 6. Base 3 is substantially U-shaped and includes first and second sidewalls 32 and a main section 31 extending between first and second sidewalls 32. Main section 31 includes first and second ends 37 and 38 spaced along a first axis X. Main section 31 includes first and second holes 311 and 312 spaced along first axis X. A protrusion 314 is formed between first and second holes 311 and 312. First and second sidewalls 32 are spaced along a second axis Y perpendicular to first axis X and each include first and second ends 33 and 34 spaced along first axis X. First and second sidewalls 32 include aligned first sliding slots 321 adjacent first ends 33 and aligned second sliding slots 322 adjacent second ends 34. Each of first and second sliding slots 321 and 322 has a length extending along first axis X. First and second sidewalls 32 further include aligned first guiding slots 323 and aligned second guiding slots 324. First guiding slot 323 on each of first and second sidewalls 32 is located between first sliding slot 321 and second sliding slot 322 along first axis X. Furthermore, first guiding slot 323 includes a vertical section 327 extending in a direction parallel to first sliding slot 321 and an inclined section 328 at an obtuse angle (about 130° in the form shown) to vertical section 327. Second guiding slot 324 on each of first and second sidewalls 32 is located between first guiding slot 323 and first sliding slot 321 along first axis X. Second guiding slot 324 has a length extending along a third axis X perpendicular to first and second axes X and Y (i.e., perpendicular to first sliding slot 321). First and second sidewalls 32 further include aligned pin holes 329 at first ends 33 thereof. First and second sidewalls 32 further include aligned positioning holes 325. Positioning hole 325 on each of first and second sidewalls 32 is spaced from first guiding slot 323 along third axis Z. It can be appreciated that first and second guiding slots 323 and 324 of base 3 are not utilized or even can be omitted when utilizing the universal assembly of FIG. 2 as bottom latch 25. In assembly, a screw 35 (the lower one in FIG. 4) is extended through first hole 311 of base 3 into a side 11 of door 1, and another screw 35 (the upper one in FIG. 4) is extended through second hole 312 into side 11 of door 1. Base 3 is, thus, fixedly mounted to door 1.

Figure 6:
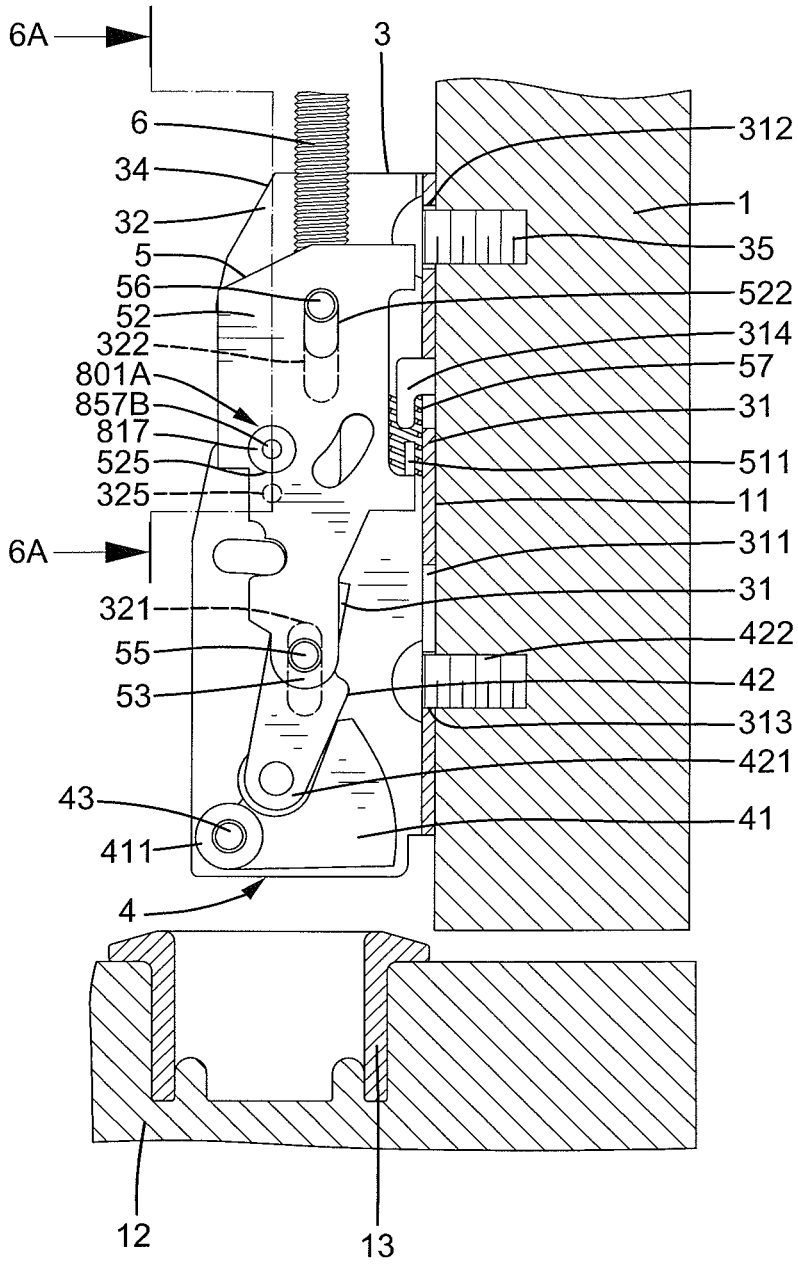
FIG. 6 shows a view similar to FIG. 4, with the latch bolt of the bottom latch in an unlatching position.
Figure 7:
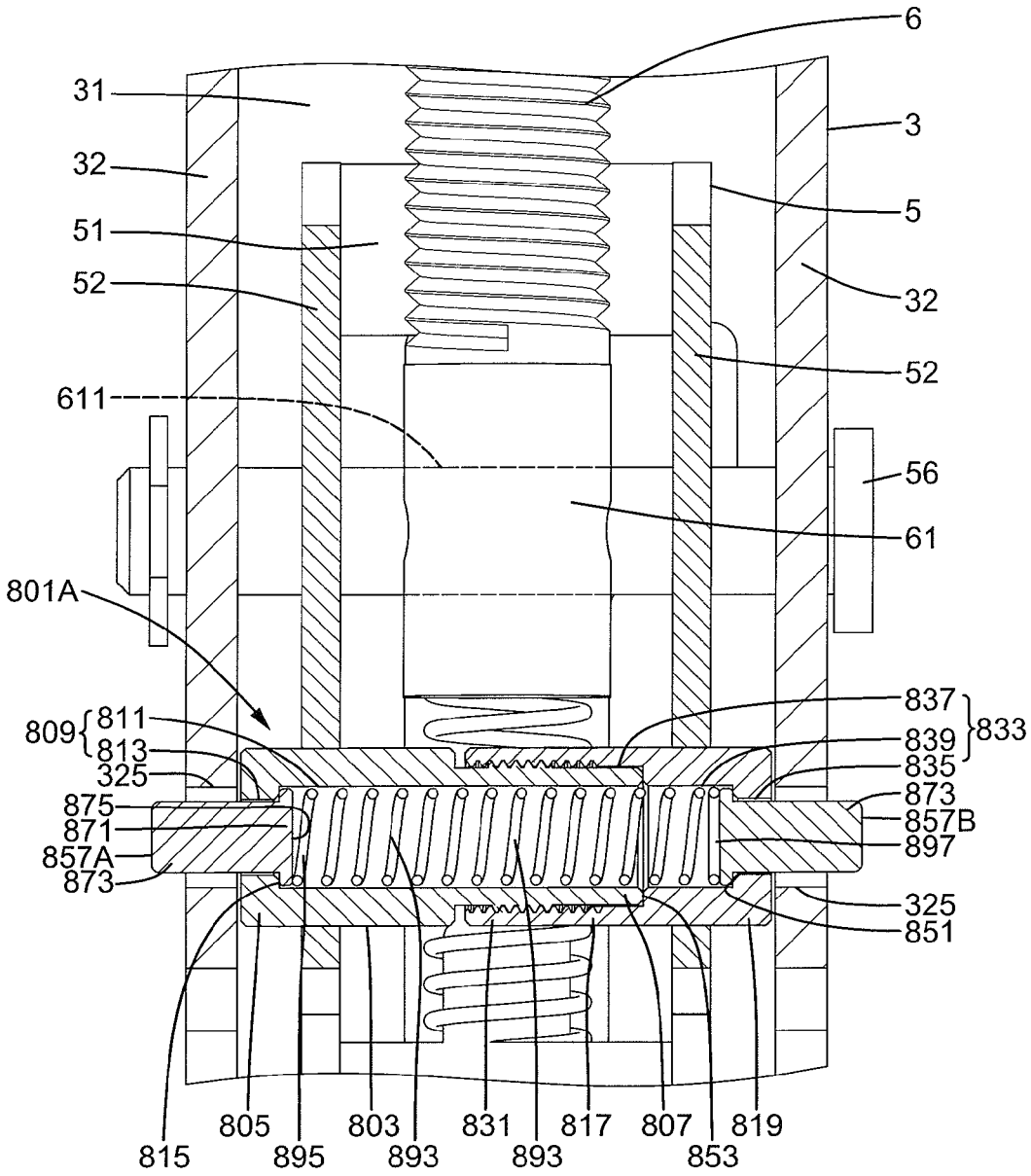
FIG. 7 shows a view similar to FIG. 5, with a safety pin of the safety device for the bottom latch in an extended position.

According to the form shown, latch bolt 4 is mounted between first and second sidewalls 32 of base 3 and includes a latch 41 and a link 42. Latch 41 includes a first pivotal portion 411 on an end thereof and a second pivotal portion 412 between two ends of the latch 41. A pin 43 is extended through pin holes 329 of first and second sidewalls 32 of base 3 and first pivotal portion 411. Thus, the other end of latch 41 is pivotable between a latching position (FIG. 4) outside base 3 and an unlatching position (FIG. 6) inside base 3 about a pivot axis parallel to second axis Y. Link 42 includes a first end 421 pivotally connected to second pivotal portion 412 and a second end 422. Link 42 is substantially U-shaped and includes two sidewalls 426 spaced along second axis Y and an intermediate portion 424 extending between sidewalls 426.

Sidewalls 426 include aligned holes 425 in first ends thereof and aligned holes 423 in second ends thereof. A pin 44 is extended through holes 425 of link 42 and second pivotal portion 412 of latch 41, allowing second end 422 of link 42 to pivot about a pivot axis defined by pin 44 that is parallel to the pivot axis of pin 43. A pin 55 is extended through first sliding slots 321 of base 3 and holes 423 of link 42. When pin 55 slides along first sliding slots 321, link 42 moves along first axis X and causes latch 41 to move between the latching position and the unlatching position.

According to the form shown, follower plate 5 is mounted between first and second sidewalls 32 of base 3. Follower plate 5 is substantially U-shaped and includes first and second sidewalls 52 spaced along second axis Y and an intermediate portion 51 extending between first and second sidewalls 52. Latch bolt 4 is movably received between first and second sidewalls 52 of follower plate 5. A tab or projection 511 is formed on intermediate portion 51. A spring 57 is attached between projection 511 of follower plate 5 and protrusion 314 of base 3 to bias follower plate 5. First and second sidewalls 52 include aligned holes 521 in first ends 53 thereof and aligned slots 522 in second ends 54 thereof. Each of first and second sidewalls 52 further includes an engaging notch 524 adjacent first end 53 thereof. Each of first and second sidewalls 52 further includes an inclined slot 523 between hole 521 and slot 522 and at an acute angle to an extending direction of slot 522. Each of first and second sidewalls 52 further includes an engagement hole 525 between slot 522 and engaging notch 524. Engagement hole 525 is spaced from inclined slot 523 along third axis Z. Pin 55 is parallel to pins 43 and 44 and extended through first sliding slots 321 of base 3, holes 521 of follower plate 5, and holes 423 of link 42. Thus, an end of the follower plate 5 is pivotably connected to second end 422 of link 42. Note that pin 43 is extended through pin holes 329 of first and second sidewalls 32 of base 3 and first pivotal portion 411 and that pin 44 is extended through holes 425 of link 42 and second pivotal portion 412 of latch 41. It can be appreciated that inclined slots 523 and engaging notches 524 of follower plate 5 are not utilized or even can be omitted when utilizing the latch assembly of FIG. 2 as bottom latch 25.

According to the form shown, linking rod 6 is in the form of a screw rod and includes a first end 61 without threading and a second end 62. First end 61 has a transverse hole 611 perpendicular to a longitudinal axis of linking rod 6. Second end 62 of linking rod 6 is connected to lower end 233 of lower vertical rod 232 to move therewith. It can be appreciated that second end 62 of linking rod 6 can be integrally formed with lower end 233 of lower vertical rod 232. A pin 56 parallel to pins 43, 44, and 55 is extended through second sliding slots 322 of base 3, slots 522 of follower plate 5, and transverse hole 611 of first end 61 of linking rod 6. Thus, follower plate 5 can be moved in the vertical direction together with linking rod 6 to move latch 41 between the unlatching position and the latching position when touch bar 22 is pressed. When latch 41 is in the latching position (FIG. 4), engagement holes 525 of follower plate 5 are aligned with positioning holes 325 of base 3 (FIG. 5). On the other hand, when latch 41 is in the unlatching position (FIG. 6), engagement holes 525 of follower plate 5 are not aligned with positioning holes 325 of base 3.

Figure 2:
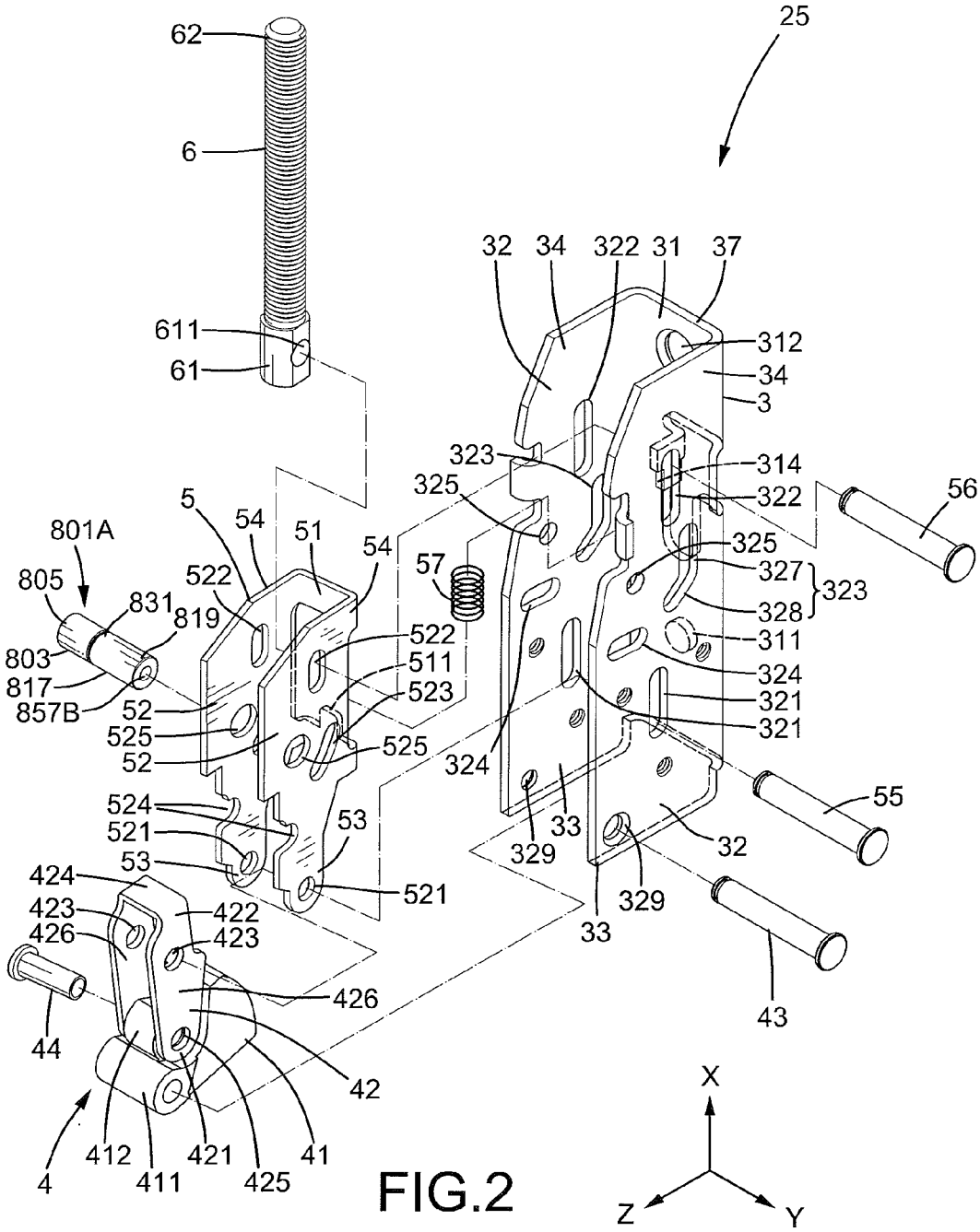
FIG. 2 shows an exploded perspective view of a bottom latch of the door lock of FIG. 1.
Figure 4:
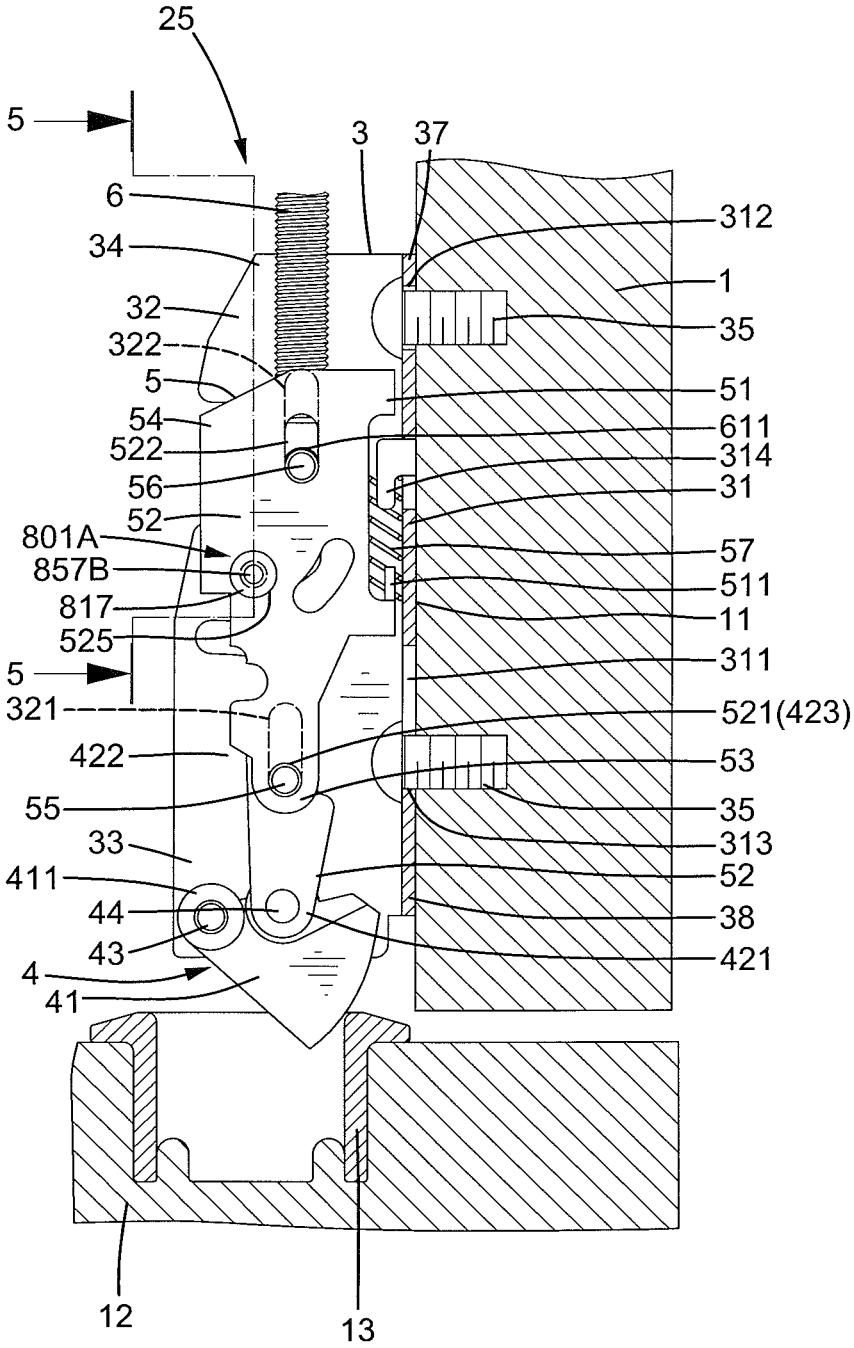
FIG. 4 shows a partial, cross-sectional view of the fireproof door of FIG. 1, with a latch bolt of the bottom latch in a latching position.
Figure 5:
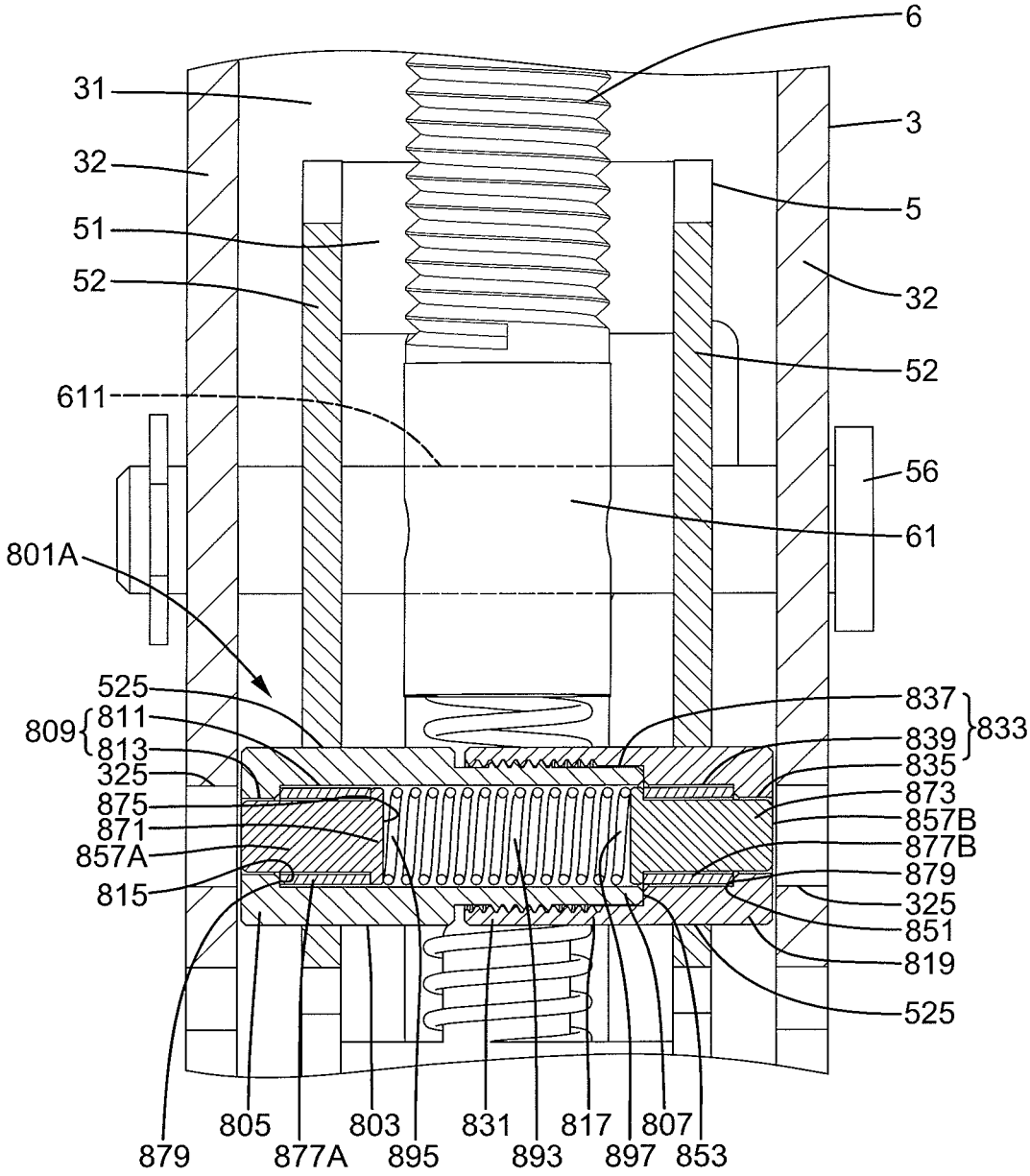
FIG. 5 shows a cross sectional view taken along section line 5-5 of FIG. 4.

Bottom latch 25 utilizing the latch assembly of FIG. 2 is shown in FIGS. 1 and 4. When latch 41 is in the latching position outside base 3 (FIG. 4), latch 41 is stopped by a strike 13 on the ground 12. Door 1 is, thus, locked. When touch bar 22 is pressed, lower vertical rod 232 and linking rod 6 are moved upward. After pin 56 reaches upper ends of slots 522, follower plate 5 moves upward together with linking rod 6, which in turn, causes upward pivotal movement of link 42 about a pivot axis defined by pin 44. Thus, follower plate 5 pivots and compresses spring 57. Latch 41 is moved to the unlatching position (FIG. 6) in base 3 and disengaged from strike 13. As mentioned above, first and second guiding slots 323 and 324 of base 3 as well as inclined slots 523 and engaging notches 524 of follower plate 5 are not utilized or can be omitted when utilizing the latch assembly of FIG. 2 as bottom latch 25. When linking rod 6 is released due to release of touch bar 22, spring 57 moves follower plate 5 away from base 3 and, thus, returns latch 41 to the latching position. It can be appreciated that idle movement of pin 56 in slots 522 of follower plate 5 provides a burglar-proof effect. Particularly, when latch 41 of door lock 2 is picked to pivot for causing link 42 and follower plate 5 to move along first axis X, the small displacement of the link 42 and follower plate 5 is smaller than or equal to the length of slot 522 along first axis X such that unlatching of the latch 41 would not occur.

Figure 3:
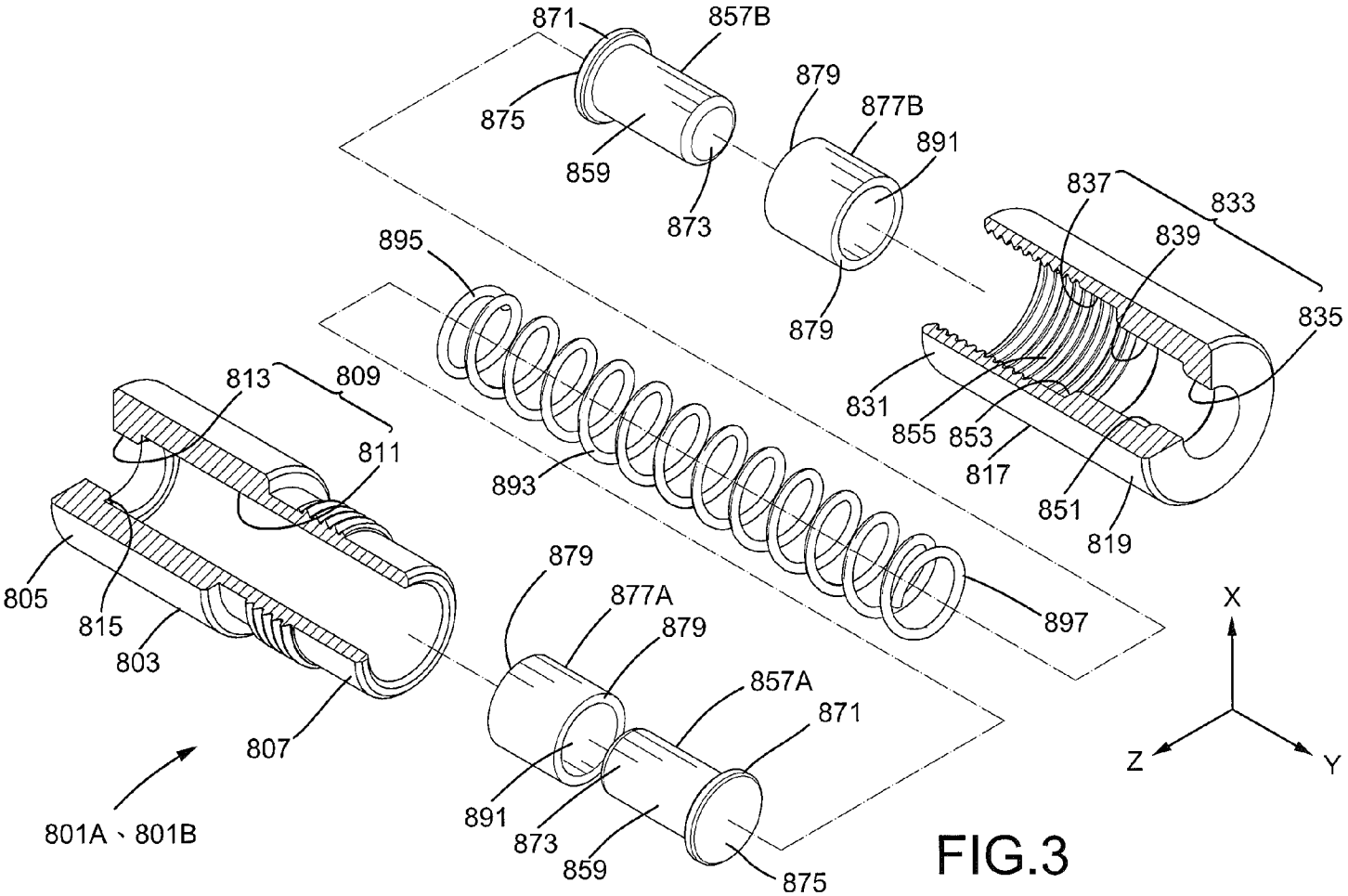
FIG. 3 shows an exploded, perspective view of the safety device.

According to the form shown, the latch assembly further includes a first safety device 801A (FIGS. 2 and 3) mounted in follower plate 5 of bottom latch 25. First safety device 801A includes first and second sleeves 803 and 817 engaged with each other. First sleeve 803 includes a first end 805 and a second end 807 spaced from first end 805 along second axis Y and having a diameter smaller than that of first end 805. A receiving hole 809 extends from first end 805 through second end 807. Receiving hole 809 includes a smaller section 813 extending from first end 805 towards but spaced from through second end 807 and a larger section 811 extending from second end 807 through smaller section 813 and having a diameter larger than smaller section 813, with a shoulder 815 formed in an intersection of larger and smaller sections 811 and 813. Second sleeve 817 includes a first end 819 and a second end 831 spaced from first end 819 along second axis Y. A mounting hole 833 extends from first end 819 through second end 831. Mounting hole 833 includes a first hole section 835 extending from first end 819 towards but spaced from second end 831, a second hole section 837 extending from second end 831 towards but spaced from first end 819, and an intermediate hole section 839 between first and second hole sections 835 and 837, with a first abutment face 851 formed at an intersection of first hole section 835 and intermediate hole section 839, and with a second abutment face 853 formed at an intersection of intermediate hole section 839 and second hole section 837. Second hole section 837 includes an inner threading 855 spaced from second abutment face 853.

Second end 807 of first sleeve 803 of first safety device 801A is threaded into second hole section 837 of second sleeve 817 and engaged with inner threading 855. An end face of second end 807 of first sleeve 803 abuts second abutment face 853 of second sleeve 817 (FIG. 5). First end 805 of first sleeve 803 and first end 819 of second sleeve 817 respectively extend into engagement holes 525 of follower plate 5. Thus, first and second sleeves 803 and 817 can move jointly with follower plate 5.

According to the form shown, first safety device 801A further includes first and second stops 877A and 877B respectively mounted in first and second sleeves 803 and 817. First and second stops 877A and 877B are made of a material having a melting point lower than firs and second sleeves 803 and 817, such as plastic. Each of first and second stops 877A and 877B has two ends 879 and a through-hole 891 extending from an end 879 through the other end 879. First stop 877A has an outer diameter slightly smaller than the inner diameter of larger section 811 of first sleeve 803. First stop 877A is received in larger section 811 of first stop 877A, with an end 879 abutting shoulder 815. Second stop 877B has an outer diameter smaller than the inner diameter of intermediate hole section 839 of second sleeve 817. Second stop 877B is received in intermediate hole section 839 of second sleeve 817, with an end 879 abutting first abutment face 851. A length of second stop 877B along second axis Y is equal to a length of intermediate hole section 839 of second sleeve 817. The melting point of each of first and second safety pins 857A and 857B are higher than that of first and second stops 877A and 877B.

According to the form shown, first safety device 801A further includes first and second safety pins 857A and 857B respectively mounted in first and second sleeves 803 and 817. Each of first and second safety pins 857A and 857B has a cylindrical shank 859 and a flange 871 on an end of shank 859 and having an end face 875. Shank 859 further has a distal end 873 away from flange 871.

First safety pin 857A is mounted in receiving hole 809 of first sleeve 803, with shank 859 of first safety pin 857A extending through through-hole 891 of first stop 877A. A length of shank 859 along second axis is equal to a sum of a length of first stop 877A and a length of smaller section 813 of receiving hole 809 along second axis Y. An outer diameter of shank 859 of first safety pin 857A is slightly smaller than the inner diameter of smaller section 813 of receiving hole 809 of first sleeve 803 and slightly smaller than through-hole 891 of first stop 877A. An outer diameter of flange 871 of first safety pin 857A is slightly smaller than the inner diameter of larger section 811 of receiving hole 809 of first sleeve 803 but larger than the inner diameter of through-hole 891 of first stop 877A, such that flange 871 of first safety pin 857A abuts an end 879 of first stop 877A distant to shoulder 815. Furthermore, distal end 873 of shank 859 is extended through smaller section 813 of first sleeve 803, and an end face of distal end 873 of shank 859 of first safety pin 857A is flush with the end face of first end 805 of first sleeve 803.

Second safety pin 857B is mounted in mounting hole 833 of second sleeve 817. A length of shank 859 of second safety pin 857B along second axis Y is equal to the sum of a length of second stop 877B and a length of first hole section 835 of mounting hole 833 along second axis Y. An outer diameter of shank 859 of second safety pin 857B is slightly smaller than the inner diameter of first hole section 835 of mounting hole 833 of second sleeve 817 and slightly smaller than the inner diameter of through-hole 891 of second stop 877B. An outer diameter of flange 871 of second safety pin 857B is slightly smaller than the inner diameter of second hole section 837 of mounting hole 833 of second sleeve 817 but larger than the inner diameter of through-hole 891 of second stop 877B, such that flange 871 of second safety pin 857B abuts an end 879 of second stop 877B distant to first abutment face 851. Furthermore, distal end 873 of shank 859 of second safety pin 857B is extended through first hole section 835 of second sleeve 817, and an end face of distal end 873 of shank 859 of second safety pin 857B is flush with the end face of first end 819 of second sleeve 817. According to the form shown, first safety device 801A further includes a spring 893 mounted in larger section 811 of first sleeve 803 and having first and second ends 895 and 897. First end 895 of spring 893 presses against end face 875 of first safety pin 857A, and second end 897 of spring 893 presses against end face 875 of second safety pin 857B (FIG. 5). Thus, spring 893 biases first safety pin 857A towards first sidewall 32 of base 3 and biases second safety pin 857B towards second sidewall 32 of base 3.

However, first and second safety pins 857A and 857B are still stopped by first and second stops 877A and 877B, such that distal ends 873 of first and second safety pins 857A and 857B are in retracted positions in first and second sleeves 803 and 817 and, thus, can not extend beyond first and second sleeves 803 and 817. Namely, follower plate 5 can move along first axis X.

Base 3 of bottom latch 25 shown in FIGS. 1 and 4 is of surfaced type. However, base 3 of bottom latch 25 can be mounted in an interior of door 1 such that the whole bottom latch 25 becomes a concealed-type bottom latch.

Figure 8:
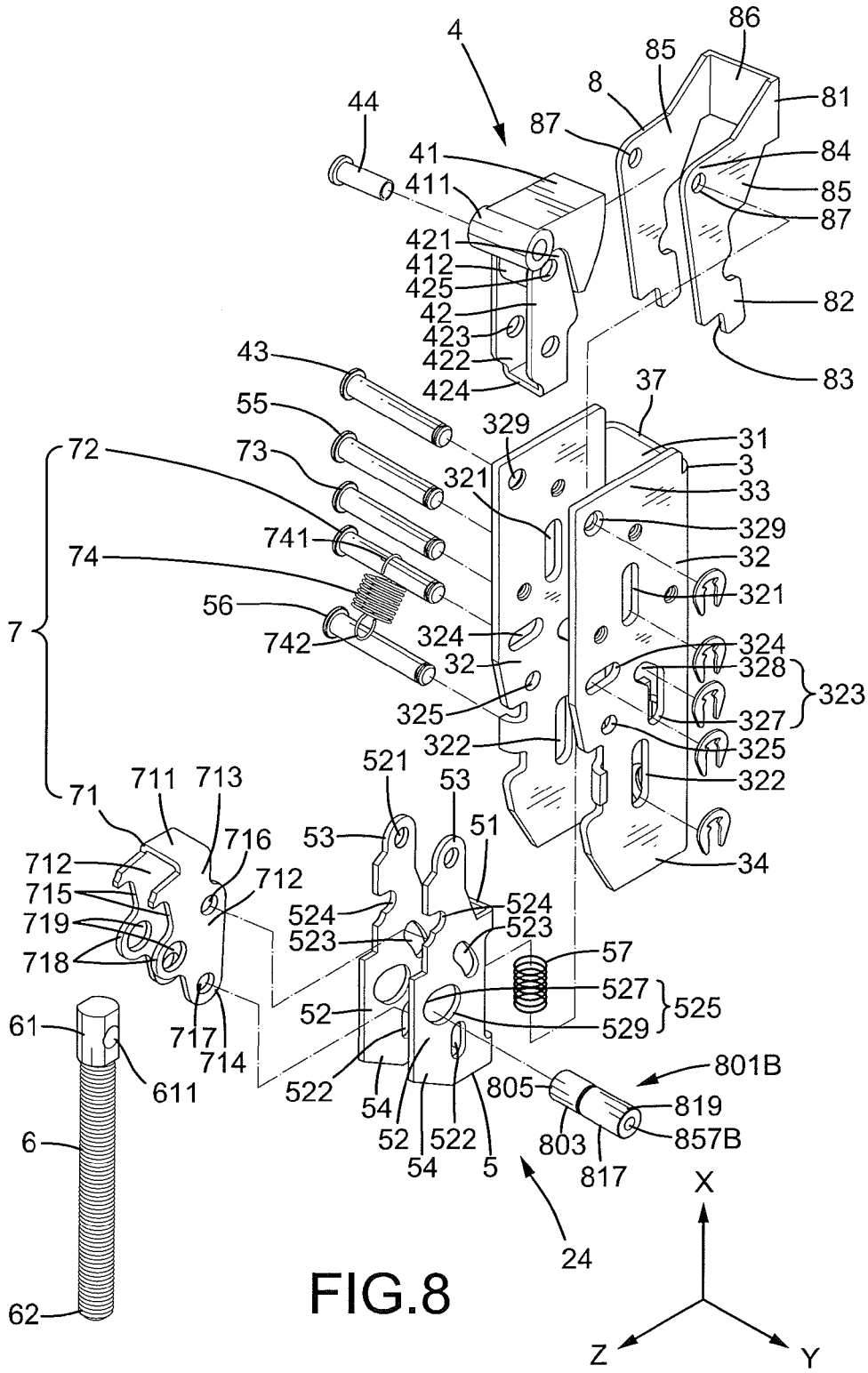
FIG. 8 shows an exploded, perspective view of a top latch of the door lock of FIG. 1.

After adding some parts, bottom latch 25 can form a surfaced-type top latch 24 for door lock 2. According to the form shown in FIG. 8, surfaced-type top latch 24 includes base 3, latch bolt 4, follower plate 5, and linking rod 6 that form bottom latch 25 but arranged in an upside-down manner, wherein like reference numerals designate like elements. Detailed description of these elements is not set forth to avoid redundancy. However, it is noted that second end 62 of linking rod 6 of top latch 24 is connected to upper end 234 of upper vertical rod 231. Top latch 24 further includes a locking device 7 and a guard plate 8. Locking device 7 is mounted on base 3 to lock latch 41 in the latching position or the unlatching position. Due to provision of locking device 7, top latch 24 and bottom latch 25 can be unlatched only when touch bar 22 is pressed. A deadlocking effect is, thus, provided. Furthermore, the shape of engagement holes 525 of follower plate 5 of top latch 24 is in the form of such as a tear drop and includes a reduced end 527 and an enlarged end 529.

According to the form shown, locking device 7 includes a safety plate 71, a positioning pin 72, and a spring 74 in the form shown as a tension spring. Safety plate 71 is movably received between first and second sidewalls 52 of follower plate 5 and includes two sidewalls 712 spaced along second axis Y and interconnected by an interconnecting section 711. Each sidewall 712 includes first and second ends 713 and 714. Aligned holes 717 are defined in second ends 714 of sidewalls 712. Sidewalls 712 further include aligned holes 716 between first and second ends 713 and 714 thereof. Pin 56 is extended through second sliding slots 322 of base 3, slots 522 of follower plate 5, holes 717 of safety plate 71, and transverse hole 611 of first end 61 of linking rod 6. Thus, follower plate 5 can be moved along first axis X together with linking rod 6 to move latch 41 between the unlatching position and the latching position. Furthermore, safety plate 71 can move along first axis X together with linking rod 6. A pin 73 is extended through first guiding slots 323 of base 3, inclined slots 523 of follower plate 5, and holes 716 of safety plate 71. When pin 73 is moving between two ends of inclined slots 523 and along vertical sections 327 and inclined sections 328 of first guiding slots 323, safety plate 71 pivots about a pivot axis defined by pin 56 while moving upward or downward along first axis X. Pivotal movement of safety plate 71 is limited due to limitation to first end 713 of safety plate 71 by inclined slots 523 of follower plate 5 and first guiding slots 323 of base 3.

According to the form shown, each sidewall 712 of the safety plate 71 further includes an engaging notch 715 and a lug 718 between engaging notch 715 and second end 714. Lugs 718 are aligned along second axis Y and include aligned holes 719. Engaging notches 715 can engage with positioning pin 72 (FIG. 9) or disengage from positioning pin 72 (FIG. 11) through pivotal movement of safety plate 71. Positioning pin 72 is extended through second guiding slots 324 of base 3 and movable between two ends of each second guiding slot 324. Spring 74 includes a first end 741 attached to positioning pin 72 and a second end 742 attached to pin 73 to bias positioning pin 72 and pin 73 towards each other. Thus, the follower plate 5 and the latch bolt 4 are biased upward.

Figure 10:
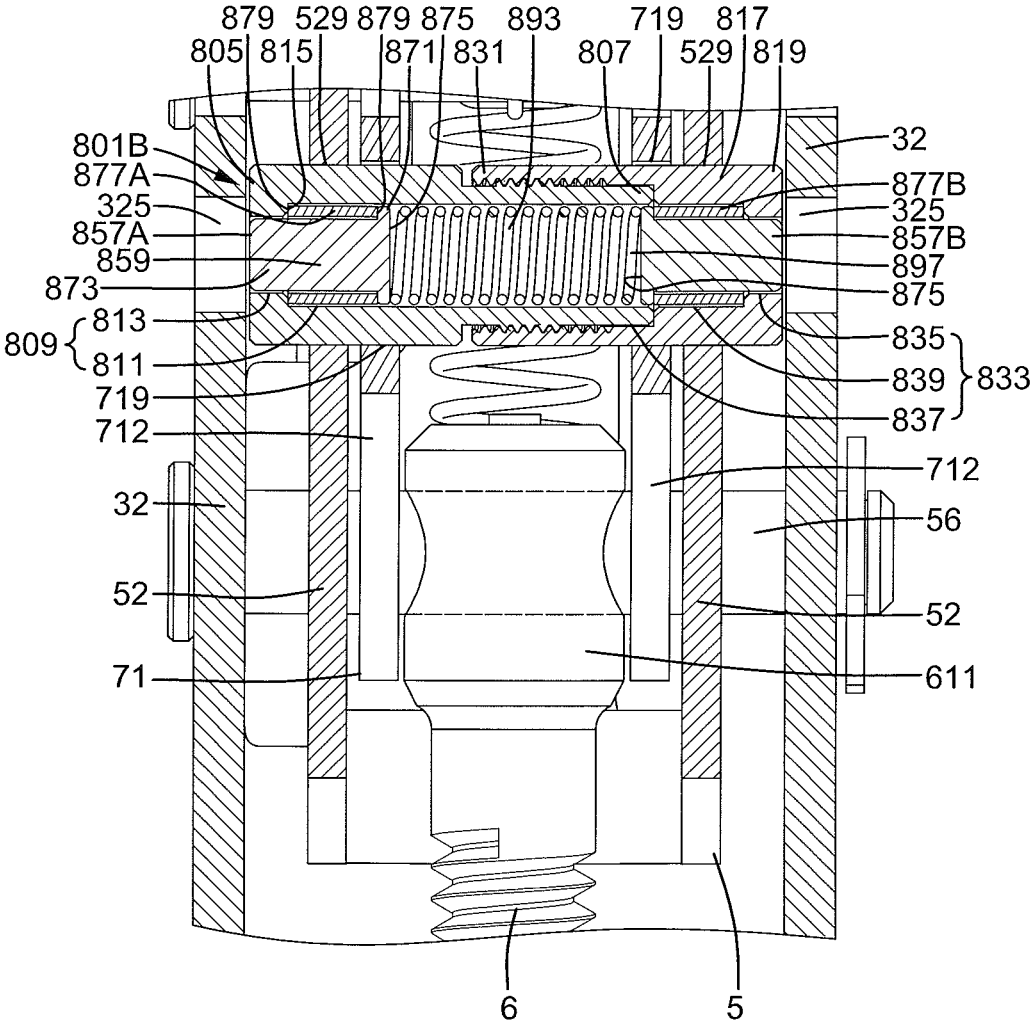
FIG. 10 shows a cross sectional view taken along section line 10-10 of FIG. 9.

According to the form shown, a second safety device 801B is mounted to safety plate 71 to move therewith. Second safety device 801B is identical to first safety device 801A, and like reference numerals designate like reference numerals. First end 805 of first sleeve 803 and first end 819 of second sleeve 817 of second safety device 801B respectively extend through holes 719 of lugs 718 of safety plate 71 into engagement holes 525 of follower plate 5 of top latch 24. Nevertheless, end faces of first ends 805 and 819 of first and second sleeves 803 and 817 of second safety device 801B are located between first and second sidewalls 32 of base 3 of top latch 24 (FIG. 10). Thus, first and second sleeves 803 and 817 of second safety device 801B move jointly with safety plate 71. Each of first ends 805 and 819 of first and second sleeves 803 and 817 of second safety device 801B is movable between reduced end 527 and enlarged end 529 of a corresponding engagement hole 525 of follower plate 5 of top latch 24. When follower plate 5 moves, safety plate 71 and first and second sleeves 803 and 817 of second safety device 801B move jointly with follower plate 5.

According to the form shown, guard plate 8 is mounted between first ends 33 of first and second sidewalls 32 of base 3. Guard plate 8 includes two sidewalls 85 spaced align second axis Y and interconnected by an interconnecting section 86 therebetween.

Each sidewall 85 includes first and second ends 81 and 82 and aligned holes 87 between first and second ends 81 and 82, providing a pivotal portion 84 between first and second ends 81 and 82 of each sidewall 85. Pin 43 is extended through pin holes 329 of base 3, first pivotal portion 411 of latch bolt 4, and holes 87 of guard plate 8, allowing first ends 81 of sidewalls 85 and interconnecting section 86 interconnected between first ends 81 to pivot outside base 3. Second end 82 of each sidewall 85 has a notch 83 that can be in contact with and movable together with positioning pin 72 of locking device 7.

Figure 9:
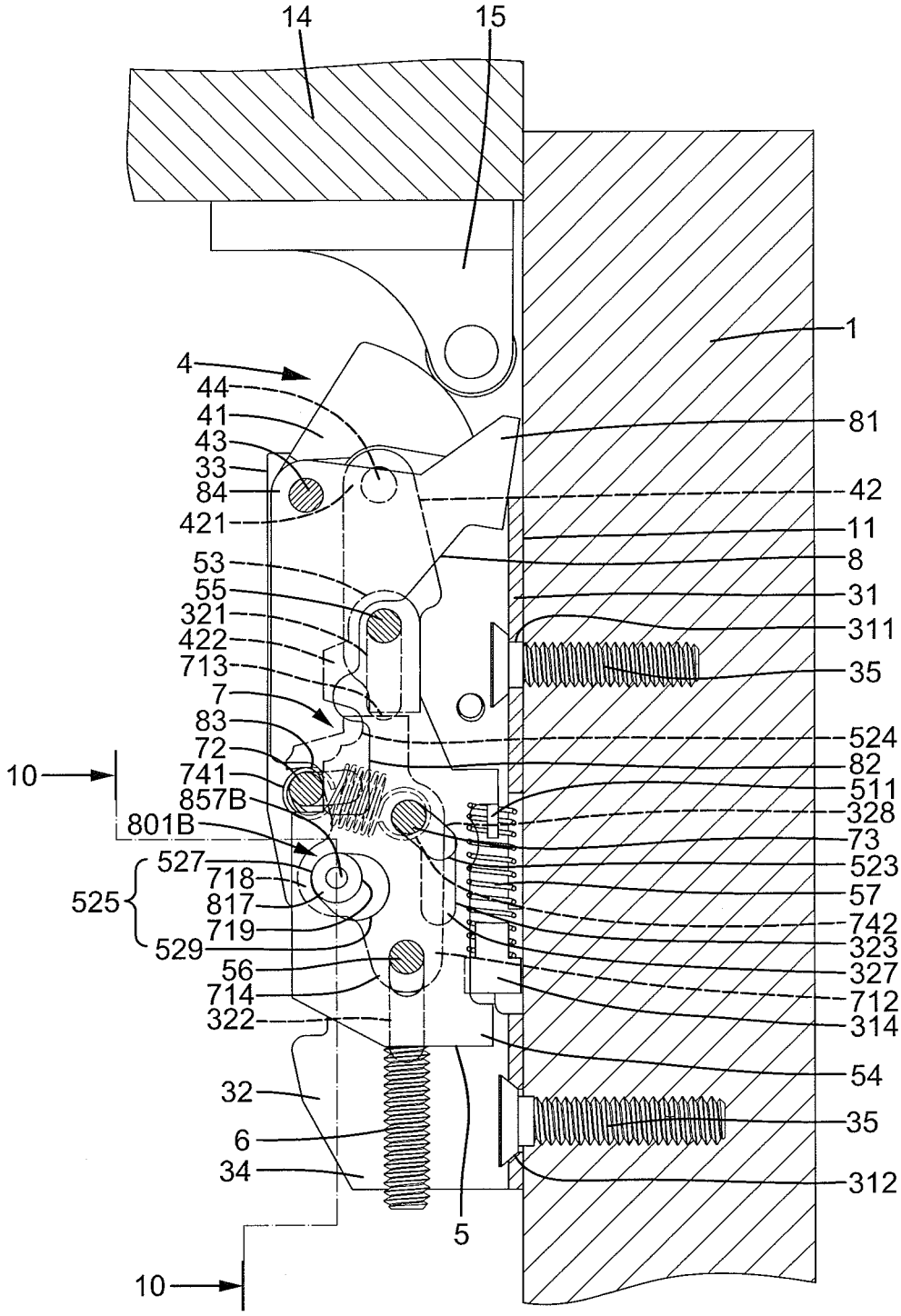
FIG. 9 shows a partial, cross-sectional view of the door of FIG. 1, with a latch bolt of the top latch in a latching position.

With reference to FIG. 9, when latch 41 of latch bolt 4 is in the latching position outside base 3, latch 41 of top latch 24 is stopped by a strike 15 on an upper beam 14 of a door frame. Door 1 is, thus, locked. In this case, first and second safety pins 857A and 857B of second safety device 801B are aligned with positioning holes 325 of base 3 of top latch 24, and positioning pin 72 is engaged with engaging notches 715 of safety plate 71 to lock latch 41 in the latching position. When latch 41 of top latch 24 is pivoted through a small angle due to picking, link 42, follower plate 5, and safety plate 71 jointly move downward through a small travel along first axis X. Since positioning pin 72 is engaged in engaging notches 715 of safety plate 71, the travel of follower plate 5 along first axis X is insufficient to move latch 41 from the latching position to the unlatching position, providing anti-picking function. Note that spring 74 biases positioning pin 72 and pin 73 toward each other to retain positioning pin 72 in engaging notches 715 of safety plate 71. Furthermore, since bottom latch 25 must move jointly with top latch 24, latch 41 of bottom latch 25 remains in the latching position as long as latch 41 of top latch 24 is prevented from being picked.

Figure 11:
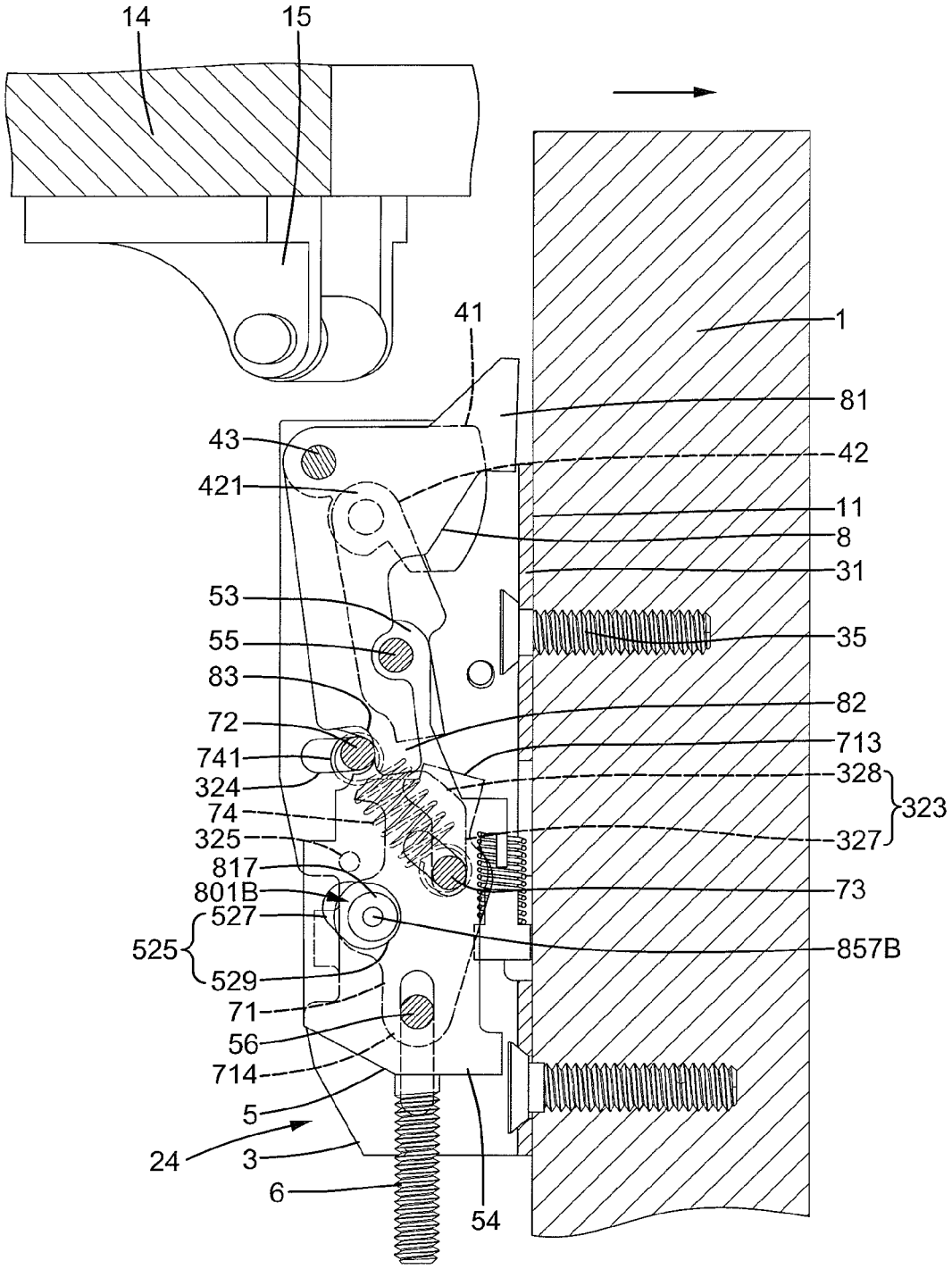
FIG. 11 shows a view similar to FIG. 9, with the latch bolt of the top latch in an unlatching position, and with the door opened.

When the touch bar 22 is pressed to move upper vertical rod 231 downward and to move lower vertical rod 232 upward along first axis X, linking rod 6 carries safety plate 71 downward along first axis X, such that first end 713 of safety plate 71 is actuated by pin 73 to cause engaging notches 715 to pivot away from positioning pin 72. When pin 73 is moved to an intersection of vertical section 327 and inclined section 328 of each first guiding slot 323 of base 3, pin 73 is located in an end of inclined slot 523 of follower plate 5, and engaging notches 715 of safety plate 71 are completely disengaged from positioning pin 72. Thus, pin 73 can move further downward along vertical sections 327 of first guiding slots 323 of base 3, causing latch 41 to move from the latching position to the unlatching position through transmission by link 42. When pin 73 is in distal ends of vertical sections 327 of first guiding slots 323, latch 41 is in the unlatching position, and first and second safety pins 857A and 857B of second safety device 801B are not aligned with positioning holes 325 of base 3 of top latch 24 (FIG. 11). With reference to FIG. 11, when latch 41 of top latch 24 is in the unlatching position, positioning pin 72 is engaged in engaging notches 524 of follower plate 5, preventing follower plate 5 from moving upward along first axis X. Thus, latch 41 is retained in the unlatching position so that the latch 41 does not extend beyond the base 3 to interrupt closing of the door 1.

Figure 12:
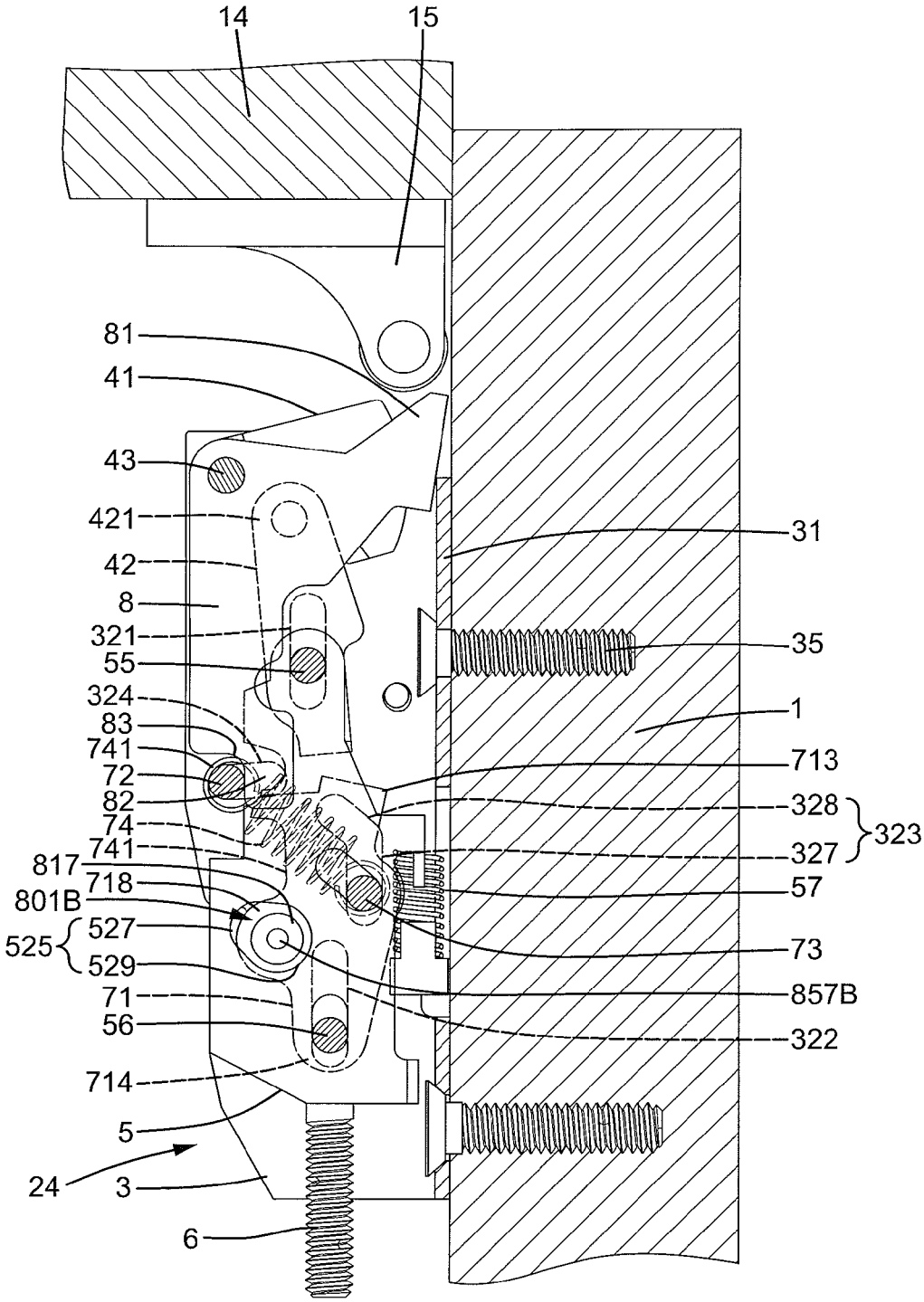
FIG. 12 shows a view similar to FIG. 11, with the latch bolt of the top latch being about to move from the unlatching position to the latching position.
Figure 13:
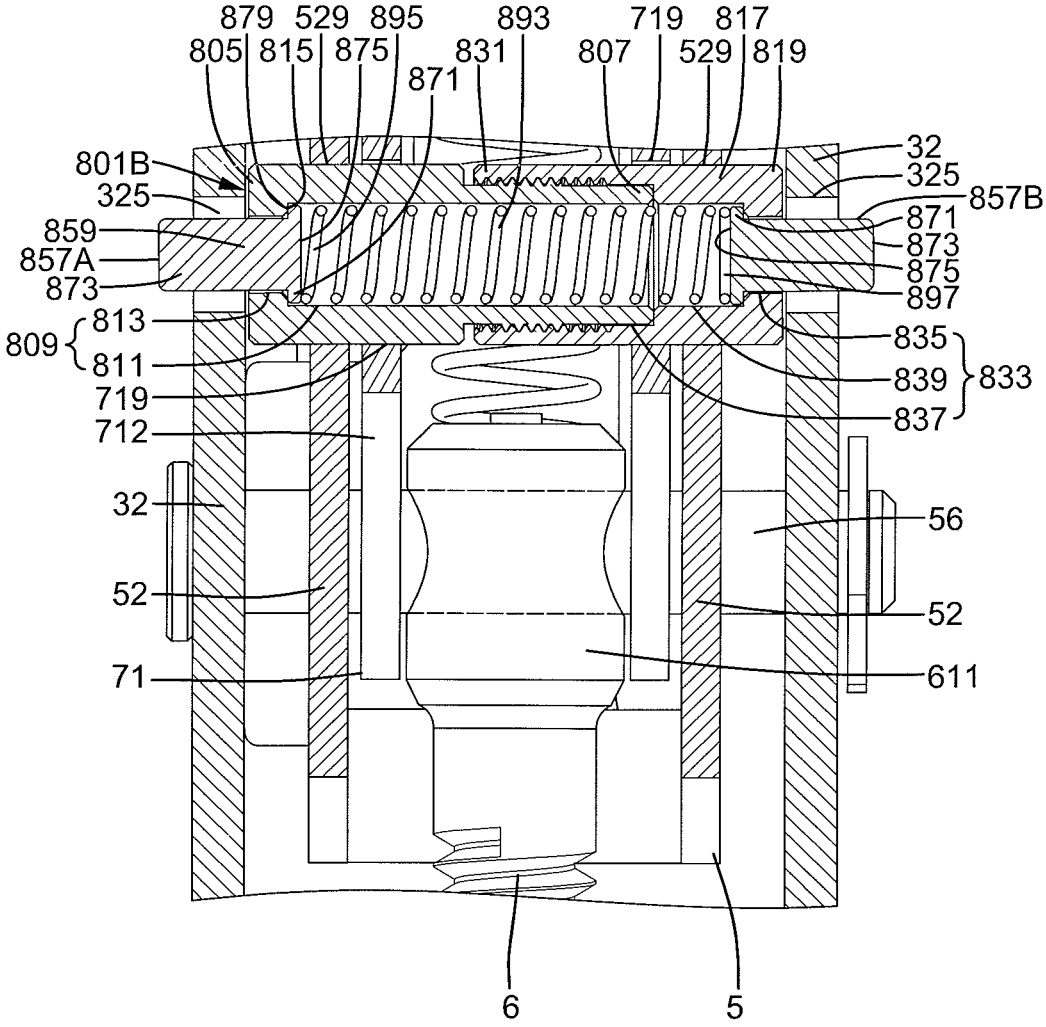
FIG. 13 shows a view similar to FIG. 10, with a safety pin of the safety device for the top latch in an extended position.

When closing door 1 in a state shown in FIG. 11, strike 15 presses against interconnecting section 86 between first ends 81 of sidewalls 85 of guard plate 8 (FIG. 12). Guard plate 8 pushes positioning pin 72, disengaging positioning pin 72 from engaging notches 524 of follower plate 5. Specifically, when first ends 81 of sidewalls 85 and/or interconnecting section 86 of guide plate 8 is impinged by strike 15 while closing door 1, second ends 82 of sidewalls 85 of guard plate 8 pivot towards positioning pin 72 and, thus, disengage positioning pin 72 from engaging notches 524 of follower plate 5. Follower plate 5 is biased by spring 57 to move upward along first axis X. At the same time, spring 74 pulls pin 73 to the upper ends of inclined slots 523 of follower plate 5. Then, follower plate 5 is moved upward along first axis X, moving latch 41 from the unlatching position to the latching position. Pin 73 moves upward along inclined slots 523 of follower plate 5 under action of spring 74, causing upward movement of safety plate 71. Furthermore, safety plate 71 returns to and is retained in the position shown in FIG. 9 under the action of spring 74 and guidance by inclined slots 523 of follower plate 5 and first guiding slots 323 of base 3. This is because positioning pin 72 is engaged in engaging notches 715 of safety plate 71.

Now that the basic construction of door lock 2 including top and bottom latches 24 and 25 of the present invention has been explained, the operation and some of the advantages of top and bottom latches 24 and 25 can be set forth and appreciated. In particular, for the sake of explanation, it will be assumed that latches 41 of top and bottom latches 24 and 25 are in their latching positions (FIGS. 4 and 9), first and second safety pins 857A and 857B of first and second safety devices 801A and 801B are in their retracted positions in first and second sleeves 803 and 817 (FIGS. 5 and 10). Smaller section 813 of first sleeve 803 and first hole section 835 of second sleeve 817 of first safety device 801A are aligned with positioning holes 325 of base 3 of bottom latch 25. Smaller section 813 of first sleeve 803 and first hole section 835 of second sleeve 817 of second safety device 801B are aligned with positioning holes 325 of base 3 of top latch 24. First end 805 of first sleeve 803 of first sleeve 803 and first end 819 of second sleeve 817 of second safety device 801B are received in reduced ends 527 of engagement holes 525 of follower plate 5 of top latch 24 (FIG. 9). Since first and second safety pins 857A and 857B of first and second safety devices 801A and 801B are in the retracted positions, latches 41 of top and bottom latches 24 and 25 can be moved from the latching positions (FIGS. 4 and 9) to the unlatching positions (FIGS. 6 and 11) by operating touch bar 22.

When latch 41 of top latch 24 moves from the latching position to the unlatching position, second safety device 801B moves jointly with safety plate 71, such that first end 805 of first sleeve 803 of first sleeve 803 and first end 819 of second sleeve 817 of second safety device 801B are received in enlarged end 529 of engagement holes 525 of follower plate 5 of top latch 24 (FIG. 11).

In a case that a fire occurs while latches 41 of top and bottom latches 24 and 25 are in the latching positions (FIGS. 4 and 9), first and second stops 877A and 877B of first and second safety devices 801A and 801B made of plastic melt due to the heat. Each first safety pin 857A of first and second safety devices 801A and 801B is moved from the retracted position to an extended position into one of positioning holes 325 of base 3 of top or bottom latch 24 or 25 under the action of spring 893. Likewise, each second safety pin 857B of first and second safety devices 801A and 801B is moved from the retracted position to an extended position into the other positioning hole 325 of base 3 of top or bottom latch 24 or 25 under the action of spring 893. Thus, follower plate 5 of bottom latch 25 is positioned by first and second safety pins 857A and 857B of first safety device 801A. Follower plate 5 and safety plate 71 of top latch 24 are positioned by first and second safety pins 857A and 857B of second safety device 801B. As a result, top and bottom latches 24 and 25 can not be unlatched by operating touch bar 22 during the fire. Thus, latches 41 of top and bottom latches 24 and 25 can effectively be retained in the latching positions during the fire, avoiding expansion of the fire by avoiding opening of door 1.

Now that the basic teachings of the present invention have been explained, many extensions and variations will be obvious to one having ordinary skill in the art. For example, the length of shank 859 of first safety pin 857A of each of first and second safety devices 801A and 801B can be slightly smaller than the sum of the length of the first stop 877A and the length of smaller section 813 along second axis Y, such that distal end 873 of first safety pin 857A is received in smaller section 813 of first sleeve 803. Likewise, the length of shank 859 of second safety pin 857B of each of first and second safety devices 801A and 801B can be slightly smaller than the sum of the length of the second stop 877B and the length of first hole section 835 along second axis Y, such that distal end 873 of second safety pin 857B is received in first hole section 835 of second sleeve 817. Furthermore, first and second stops 877A and 877B of first and second safety devices 801A and 801B can have cross sections other than the cylindrical shape. Further, first and second stops 877A and 877B can be of other forms. As an example, each of first and second stops 877A and 877B can be comprised of two arcuate plates or a plurality of cylindrical members sandwiched between the inner periphery of large section 811 and shank 859 of first safety pin 857A or between the inner periphery of intermediate hole section 839 and shank 859 of second safety pin 857B. Further, mounting hole 833 of second sleeve 817 of one or both of first and second safety devices 801A and 801B does not have to include intermediate hole section 839 and second abutment face 853. In this case, second hole section 837 extends to first hole section 835, but second end 807 of first sleeve 803 is adjacent to first abutment face 851 of second sleeve 817. Further, the inner diameter of large section 811 is smaller than the inner diameter of first hole section 835, such that an end 879 of second stop 877B abuts first abutment face 851 to keep second safety pin 857B in the retracted position.

Furthermore, only first or second safety device 801A, 801B can be utilized in top latch 24 or bottom latch 25. Further, engagement of only one of first and second safety pin 857A and 857B with base 3 of top latch 24 or bottom latch 25 is sufficient to retain latch 41 thereof in position.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch assembly for a door lock comprising, in combination:

a base (3) including first and second sidewalls (32) and a main section (31) extending between the first and second sidewalls (32), with each of the first and second sidewalls (32) including a positioning hole (325), with the main section (31) adapted to be mounted to a door (1);

a latch bolt (4) movably received between the first and second sidewalls (32) of the base (3), with the latch bolt (4) including a latch (41) having a first pivotal portion (411) pivotably connected to the first and second sidewalls (32) of the base (3) and a second pivotal portion (412), with the latch (41) movable between a latching position outside the base (3) and an unlatching position inside the base (3), with a link (42) including a first end (421) pivotably connected to the second pivotal portion (412) of the latch (41) and a second end (422), with the second end (422) of the link (42) slideably engaged with the first and second sidewalls (32) of the base (3), with movement of the link (42) along a first axis (X) causing movement of the latch (41) between the latching position and the unlatching position;

a follower plate (5) movable along the first axis (X), with the follower plate (5) including first and second sidewalls (52) spaced along a second axis (Y) perpendicular to the first axis (X), with each of the first and second sidewalls (52) of the follower plate (5) including first and second ends (53, 54), with an engagement hole (525) formed in each of the first and second sidewalls (52) of the follower plate (5) and located between the first and second ends (53, 54) of the first and second sidewalls (52) of the follower plate (5), with the first and second sidewalls (52) of the follower plate (5) movably received between the first and second sidewalls (32) of the base (3), with the first ends (53) of the first and second sidewalls (52) of the follower plate (5) pivotably connected to the second end (422) of the link (42), allowing pivotal movement of the follower plate (5) and the link (42) relative to the base (3), and allowing relative pivotal movement between the follower plate (5) and the link (42) to permit movement of the follower (5) along the first axis (X), with the engagement holes (525) of the follower plate (5) aligned with the positioning holes (325) of the base (3) when the latch (41) is in the latching position, with the engagement holes (525) of the follower plate (5) not aligned with the positioning holes (325) of the base (3) when the latch (41) is in the unlatching position;

a linking rod (6) including a first end (61) coupled with the second ends (54) of the first and second sidewalls (52) of the follower plate (5) to move therewith, with the linking rod (6) further including a second end (62) adapted to be connected to a vertical rod (231, 232) of a door lock (2) mounted to the door (1) to move therewith;

a first sleeve (803) including first and second ends (805, 807) spaced along the second axis (Y), with a receiving hole (809) extending from the first end (805) through the second end (807) of the first sleeve (803), with the receiving hole (809) including a smaller section (813) extending from the first end (805) towards but spaced from the second end (807) of the first sleeve (803) and a larger section (811) extending from the second end (807) through the smaller section (813) and having a diameter larger than the smaller section (813), with the first end (805) of the first sleeve (803) received in the engagement hole (525) of the first sidewall (52) of the follower plate (5);

a second sleeve (817) including first and second ends (819, 831) spaced along the second axis (Y), with a mounting hole (833) extending from the first end (819) through the second end (831) of the second sleeve (817), with the mounting hole (833) including a first hole section (835) extending through the first end (819) of the second sleeve (817), with the mounting hole (833) further including a second hole section (837) extending through the second end (831) of the second sleeve (817), with the second end (831) of the second sleeve (817) engaged with the second end (807) of the first sleeve (803), with the first end (819) of the second sleeve (817) received in the engagement hole (525) of the second sidewall (52) of the follower plate (5), with the first and second sleeves (803, 817) movable together with the follower plate (5);

a first stop (877A) having a melting point lower than the first and second sleeves (803, 817), with the first stop (877A) received in the larger section (811) of the receiving hole (809) of the first sleeve (803);

a second stop (877B) having a melting point lower than the first and second sleeves (803, 817), with the second stop (877B) received in the mounting hole (833) of the second sleeve (817);

a first safety pin (857A) received in the receiving hole (809) of the first sleeve (803), with the first safety pin (857A) including a first shank (859) having a first distal end (873), with the first safety pin (857A) further including a first flange (871) formed on an end of the first shank (859) opposite to the first distal end (873) and having a diameter larger than a diameter of the first shank (859), with the first shank (859) of the first safety pin (857A) extending through the first stop (877A) into the smaller section (813) but not extending beyond the first end (805) of the first sleeve (803), with the first stop (877A) located between the first flange (871) of the first safety pin (857A) and the smaller section (813) of the first sleeve (803);

a second safety pin (857B) received in the mounting hole (833) of the second sleeve (817), with the second safety pin (857B) including a second shank (859) having a second distal end (873), with the second safety pin (857B) further including a second flange (871) formed on an end of the second shank (859) opposite to the second distal end (873) and having a diameter larger than a diameter of the second shank (859), with the second shank (859) of the second safety pin (857B) extending through the second stop (877B) into the first hole section (835) but not extending beyond the first end (819) of the second sleeve (817), with the second stop (877B) located between the second flange (871) of the second safety pin (857B) and the first hole section (835) of the second sleeve (817);

a spring (893) mounted in the larger section (811) of the receiving hole (809) of the first sleeve (803), with the spring (893) including a first end (895) pressing against the first flange (871) of the first safety pin (857A) and a second end (897) pressing against the second flange (871) of the second safety pin (857B), with the spring (893) biasing the first and second safety pins (857A, 857B) towards the first and second sidewalls (32) of the base (3), wherein with the latch (41) in the latching position and with the first and second stops (877A, 877B) melted by heat, the spring (893) moves the first distal end (873) of the first safety pin (857A) into the positioning hole (325) of the first sidewall (32) of the base (3) and moves the second distal end (873) of the second safety pin (857B) into the positioning hole (325) of the second sidewall (32) of the base (3), preventing the follower plate (5) from moving relative to the base (3) along the first axis (X), retaining the latch (41) in the latching position.

2. The latch assembly as claimed in claim 1, with each of the first and second stops (877A, 877B) including a through-hole (891) through which one of the first and second safety pin (857A, 857B) extends, with the first safety pin (857A) having a length along the second axis (Y) equal to or slightly smaller than a sum of a length of the first stop (877A) and a length of the smaller section (813) of the first sleeve (803) along the second axis (Y), with the second safety pin (857B) having a length along the second axis (Y) equal to or slightly smaller than a sum of a length of the second stop (877B) and the first hole section (835) of the second sleeve (817).

3. The latch assembly as claimed in claim 1, with each of the engagement holes (525) of the follower plate (5) including a reduced end (527) and an enlarged end (529), with each of the first and second sidewalls (52) of the follower plate (5) including an inclined slot (523), with the latch assembly further comprising a safety plate (71) mounted between the first and second sidewalls (52) of the follower plate (5), with the safety plate (71) including two sidewalls (712) spaced along the second axis (Y), with each of the two sidewalls (712) of the safety plate (71) including a first end (713) slideable and pivotable relative to one of the inclined slots (523) of the follower plate (5) and a second end (714) pivotably connected to the first end (61) of the linking rod (6), with each of the two sidewalls (712) of the safety plate (71) further including an engaging notch (715) and a lug (718) having a hole (719), with the first end (805) of the first sleeve (803) extending through the hole (719) of the lug (718) of one of the two sidewalls (712) of the safety plate (71), with the first end (819) of the second sleeve (817) extending through the hole (719) of the lug (718) of another of the two sidewalls (712) of the safety plate (71), allowing joint movement of the first and second sleeves (803, 817) with the safety plate (71), with a positioning pin (72) mounted to the base (3), wherein with the latch (41) in the latching position, the positioning pin (72) is engaged with the engaging notches (715) of the safety plate (71) to prevent the latch (41) from moving to the unlatching position, the first end (805) of the first sleeve (803) and the first end (819) of the second sleeve (817) are received in the reduced ends (527) of the engagement holes (525) of the follower plate (5), wherein with the latch (41) in the unlatching position, the engaging notches (715) of the safety pin (71) are disengaged from the positioning pin (72), the first end (805) of the first sleeve (803) and the first end (819) of the second sleeve (817) are received in the enlarged ends (529) of the engagement holes (525) of the follower plate (5).

4. The latch assembly as claimed in claim 1, with the mounting hole (833) of the second sleeve (817) including an intermediate hole section (839) between the first hole section (835) and the second hole section (837), with the intermediate hole section (839) having an inner diameter larger than an inner diameter of the first hole section (835) but smaller than an inner diameter of the second hole section (837), with a first abutment face (851) formed at an intersection of the first hole section (835) and the intermediate hole section (839), with a second abutment face (853) formed at an intersection of the intermediate hole section (839) and the second hole section (837), with the second end (807) of the first sleeve (803) abutting the second abutment face (853), with the second stop (877B) received in the intermediate hole section (839) of the second sleeve (817) and having an end abutting the first abutment face (851).

* * * * *